US006974383B2

(12) United States Patent
Lewis et al.

(10) Patent No.: US 6,974,383 B2
(45) Date of Patent: Dec. 13, 2005

(54) CABINET FOR AIR HANDLING EQUIPMENT

(75) Inventors: Michael D. Lewis, La Crosse, WI (US); Jeffrey D. Dehning, West Salem, WI (US); Thomas A. Ley, La Crosse, WI (US); Denzil Devon Ratliff, Lexington, KY (US); Floyd Stanley, Lexington, KY (US); Lloyd Christopher Felty, Lexington, KY (US)

(73) Assignee: American Standard International Inc., New York, NY (US)

( * ) Notice: Subject to any disclaimer, the term of this patent is extended or adjusted under 35 U.S.C. 154(b) by 408 days.

(21) Appl. No.: 10/357,031

(22) Filed: Jan. 31, 2003

(65) Prior Publication Data

US 2004/0149757 A1 Aug. 5, 2004

(51) Int. Cl.[7] ..... F24F 7/007
(52) U.S. Cl. ..... 454/338; 292/194
(58) Field of Search ..... 454/338; 292/194, 292/230, 340, 341, 341.12

(56) References Cited

U.S. PATENT DOCUMENTS

| | | | | |
|---|---|---|---|---|
| 1,743,434 | A * | 1/1930 | Cramer | 292/202 |
| 2,589,864 | A * | 3/1952 | Raskin | 52/211 |
| 2,601,164 | A * | 6/1952 | Montgomery | 52/211 |
| 2,612,399 | A * | 9/1952 | Mastrangelo | 292/340 |
| 2,959,032 | A | 11/1960 | Davis | |
| 3,540,116 | A | 11/1970 | Drahos et al. | |
| 3,703,087 | A | 11/1972 | MacLeod | |
| 4,095,646 | A | 6/1978 | Granetzke | |
| 4,747,505 | A | 5/1988 | Hansen | |
| 4,776,484 | A | 10/1988 | Hansen | |
| 4,856,295 | A | 8/1989 | Bolton et al. | |
| 5,444,990 | A | 8/1995 | McGill, III et al. | |
| 5,711,706 | A | 1/1998 | Griffin et al. | |
| 5,870,902 | A | 2/1999 | Garrett, Jr. | |
| 6,345,511 | B1 | 2/2002 | Esty et al. | |
| 6,374,571 | B1 | 4/2002 | Mann | |

FOREIGN PATENT DOCUMENTS

JP 2004284420 A * 10/2004 ..... B60J 10/04

* cited by examiner

*Primary Examiner*—Harold Joyce
(74) *Attorney, Agent, or Firm*—William J. Beres; William O'Driscoll

(57) ABSTRACT

A cabinet for air handling equipment includes a door assembly having features such as inner and outer door panels being held together and sealed by double-sided tape, which acts as a thermal break, a latch that prevents a door gasket from being crushed due to positive or negative air pressure within the cabinet, and a doorframe that is easy to assemble and install for either right-hand or left-hand swinging doors. To assemble adjacent pieces of the doorframe, sheet metal tabs of one piece are inserted into slits of the other piece. The tabs are then twisted to hold the adjacent pieces of the doorframe together.

18 Claims, 6 Drawing Sheets

CABINET FOR AIR HANDLING EQUIPMENT

BACKGROUND OF THE INVENTION

1. Field of the Invention

The present invention relates to heating, ventilating, and air conditioning systems and more specifically relates to a cabinet for housing air handling equipment.

2. Description of Related Art

Air handling equipment, such as blowers, heat exchangers, compressors, filters, etc., can help provide conditioned air to a comfort zone, such as a room or other designated area within a building. The conditioning of the air may include, but is not limited to, heating, cooling, humidifying, dehumidifying, filtering, ventilating, and various combinations thereof.

Usually a cabinet, such as a sheet metal enclosure, houses some or all of the air handling equipment. The cabinet usually provides a conduit that directs the airflow across the various pieces equipment inside the cabinet. In outdoor applications, the cabinet may also help shelter the equipment. For heating or cooling applications, the walls of the cabinet may be thermally insulated to minimize heat loss and help prevent condensation from collecting on the interior or exterior wall surfaces. An insulated door may also be needed to provide access to the equipment inside the cabinet.

Some pieces of equipment, such as the blower for instance, can be installed outside of the enclosure with ductwork placing the blower in fluid communication with the interior of the cabinet. Whether the blower is inside or outside the cabinet, the blower can be used to move the air across the rest of the air handling equipment. Depending on whether the blower discharges air into the enclosure or draws the air out, the blower may create positive or negative air pressure within the cabinet.

To prevent air from leaking between the interior and exterior of the cabinet, a gasket is usually installed around the periphery of the cabinet's access door. As straightforward as this may seem, designing an airtight, insulated hinged door for an air handling enclosure can become quite involved considering the numerous factors that may affect the design. The door, for instance, may need to swing inward for a positive-pressure cabinet and swing outward for a negative-pressure cabinet. Unforeseen obstructions at the installation site may dictate whether the door needs to be a right-hand or a left-hand swinging door. An air pressure differential between the cabinet's interior and exterior may crush the door's gasket, or the pressure may eventually cause the gasket to take a set or permanently deform in a compressed state. For insulated doors, the insulation may need to be sealed to protect the insulation from moisture.

Consequently, certain access doors for cabinets of air handling equipment may need to be custom-made for a particular application. This can be time consuming, expensive, and often impractical.

SUMMARY OF THE INVENTION

To overcome the limitations of current access doors for air handling equipment, it is an object of some embodiments of the invention to provide a door latch and strike that limit the compression of a door gasket; regardless of whether the air pressure in the cabinet is positive or negative ("negative" meaning less than atmospheric pressure).

Another object of some embodiments is to provide a door latch and strike having two engaged positions: a positive pressure position and a negative pressure position.

Another object of some embodiments is to provide a cabinet with a door latch and strike, wherein the latch moves between a positive pressure position and a negative pressure position in response to the air pressure inside the cabinet.

Another object of some embodiments is to provide a cabinet with a door latch and strike having two opposite facing detent positions that help hold the latch in its proper rotational position relative to the strike.

Another object of some embodiments is to provide a cabinet door with double-sided adhesive tape that helps hold inner and outer panels of the door together and acts as a thermal break between the two panels.

Another object of some embodiments is to create a cabinet door with inner and outer panels, wherein the inner panel has an outwardly extending flange that tucks underneath an inwardly extending flange of the outer panel to help hold the two panels together.

Another object of some embodiments is to create a cabinet door with an inner panel, an outer panel, and a hinge; wherein a dual-purpose screw attaches the hinge to the door and holds the two panels together.

Another object of some embodiments is to create a cabinet door with an inner panel, an outer panel, and a latch; wherein a dual-purpose screw attaches the latch to the door and holds the two panels together.

Another object of some embodiments is to provide a cabinet door with a door hinge and a door latch and strike, wherein the hinge and the strike have a similar mounting hole pattern that allows the strike and the hinge to interchange positions.

Another object of some embodiments is to provide a door frame whose components are interconnected by inserting a bendable tab into a mating slit.

Another object of some embodiments is to provide a door frame whose threshold and lintel are interchangeable.

Another object of some embodiments is to provide a door frame whose right jamb and left jamb are interchangeable.

One or more of these and/or other objects of the invention are provided by a cabinet for air handling equipment, wherein a door of the cabinet includes double-sided adhesive tape, interchangeable frame members, and/or a door latch and strike having relative movement between two engaged positions in response to air pressure within the cabinet.

DESCRIPTION OF THE PREFERRED EMBODIMENT

Figure 1:
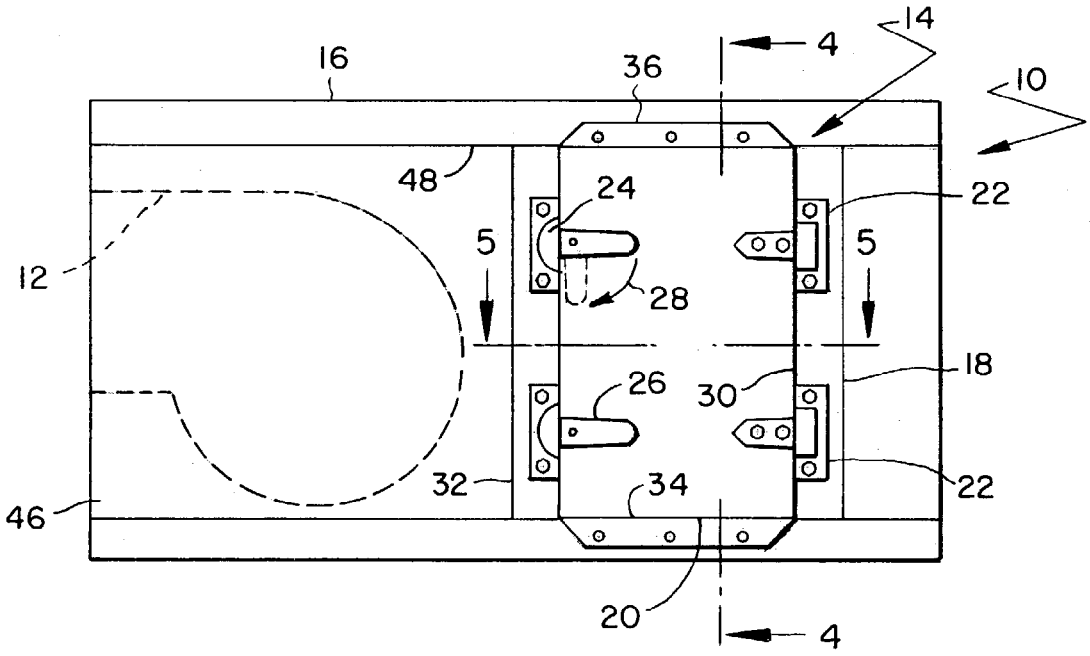
FIG. 1 is a front view of a cabinet that comprises a door assembly attached to an enclosure.

Referring to FIG. 1, a cabinet 10, whose interior can be pressurized or depressurized by a blower 12, comprises an access door assembly 14 attached to an enclosure 16. Blower 12 is schematically illustrated to represent various types of air handling equipment and/or components that can be used in or associated with cabinet 10 including, but not limited to, a blower installed inside or outside of cabinet 10 for creating a positive pressure therein or a blower for creating a negative pressure (i.e., below atmospheric pressure) within cabinet 10. Other such components can include heat exchangers for cooling, heating or dehumidifying; air filters; or dampers.

Door assembly 14 comprises a doorframe 18, a swinging door 20, at least one hinge 22 that pivotally connects door 20 to doorframe 18, at least one door strike 24 attached to doorframe 18, and at least one latch 26 for selectively holding door 20 shut or allowing it to open. Latch 26 engaging strike 24 holds door 20 closed, as shown in FIG. 1. Rotating the latch 90-degrees, e.g., in the direction of arrow 28, disengages latch 26 from strike 24, which allows door 20 to be opened. As will further be described, other features of door assembly 14 include, but are not limited to, door 20 having inner and outer panels held together and sealed by double-sided tape, latch 26 and catch 24 being able to prevent a door gasket from being crushed by positive or negative air pressure within cabinet 10, and doorframe 18 being easy to assemble and install for either right-hand or left-hand opening of door 20.

Figure 2:
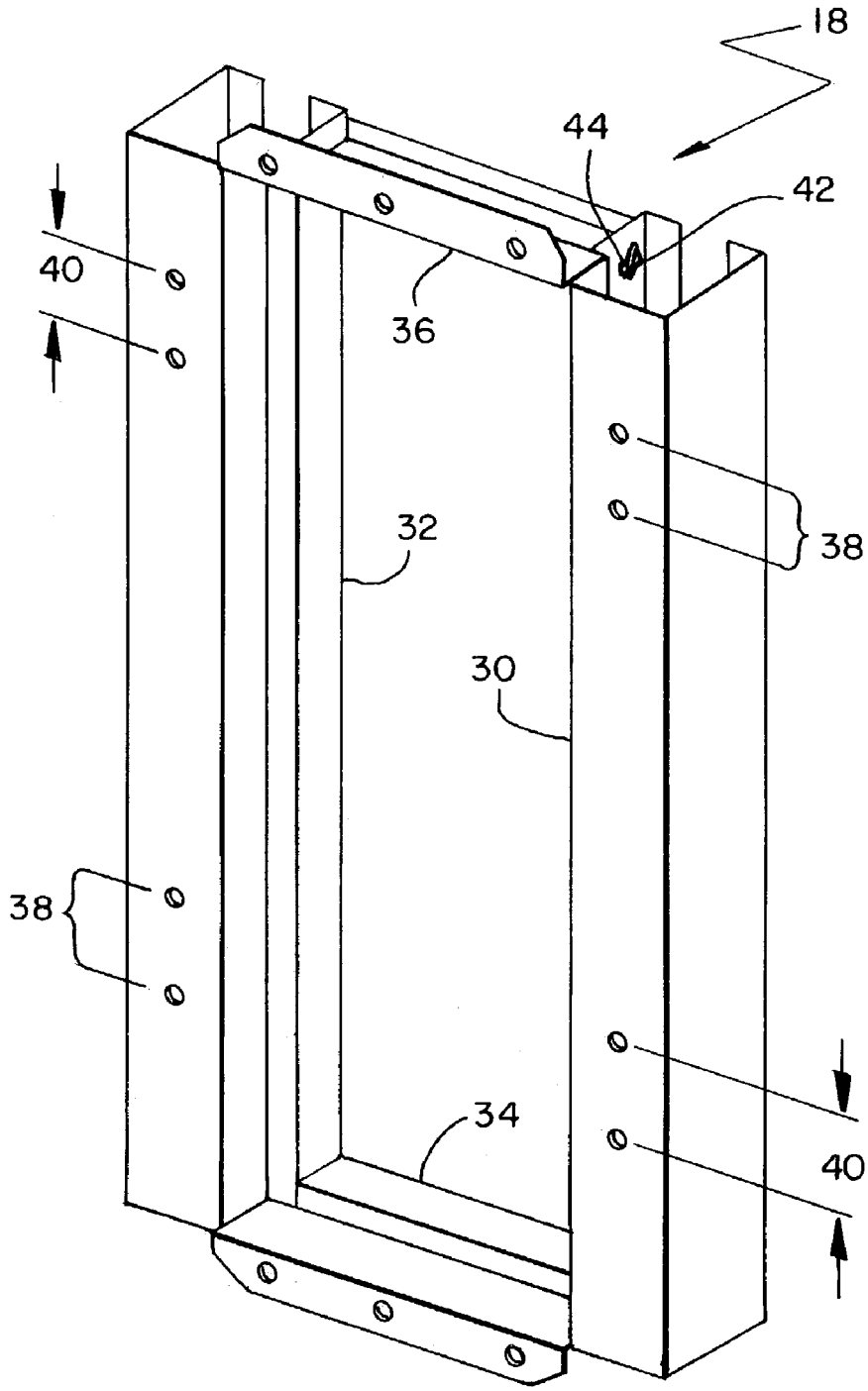
FIG. 2 is a perspective view of a doorframe of the cabinet in FIG. 1.
Figure 3:
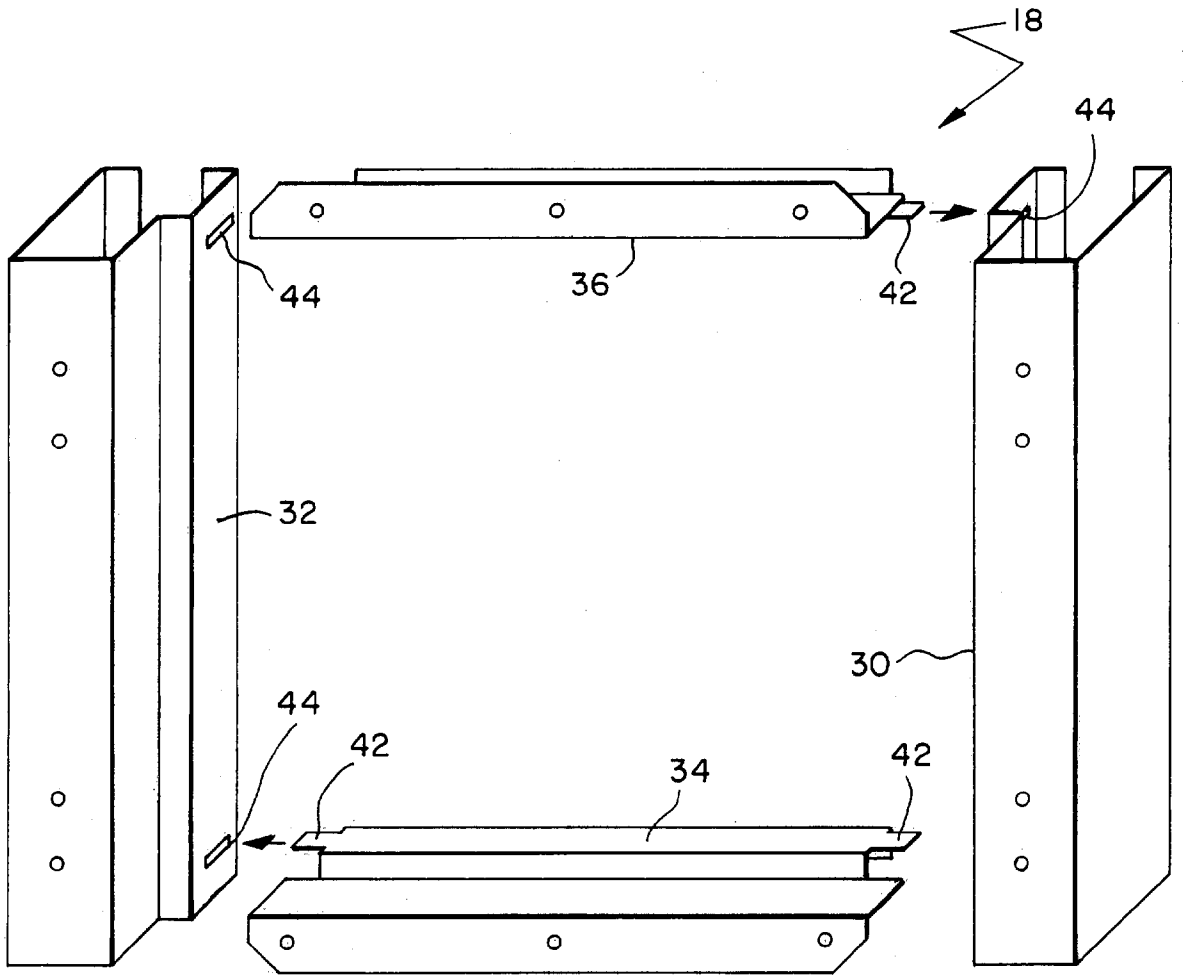
FIG. 3 is an exploded view of the doorframe of FIG. 2, but the doorframe is shown prior to assembly.

For door 20, as configured to swing outward, doorframe 18 is shown assembled in FIG. 2 and shown prior to assembly in FIG. 3. To enable doorframe 18 to be selectively installed for right-hand or left-hand swinging doors, doorframe 18 comprises a right jamb 30, a left jamb 32, a threshold 34, and a lintel 36, wherein jambs 30 and 32 are interchangeable, and threshold 34 and lintel 36 are interchangeable. The four members of doorframe 18 are preferably, but not necessarily, made of sheet metal that is formed as shown in the drawing figures. Four pairs of mounting holes 38 each have the same hole spacing 40 to allow catch 24 and door hinge 22 to be mounted to either jamb 30 or 32, thereby providing for either right-hand or left-hand door mounting. Or, if door 20 is already attached to doorframe 18, the entire door assembly 14 can be inverted to place the hinged edge of door 20 along either the right or left side of the doorframe.

To simplify the assembly of doorframe 18, each end of threshold 34 and lintel 36 includes a tab 42 that can be inserted into one of four slits 44 in jambs 30 and 32. Once tabs 42 are inserted into slits 44, tabs 42 can be twisted or bent over to hold doorframe 18 together, as shown in FIG. 2. By twisting tabs 42 door frame 18 is made more rigid than is the case where tabs 42 are simply bent over. The twisting or bending of tabs 42 will preferably be done manually with the use of a simple tool designed for the purpose.

Figure 4:
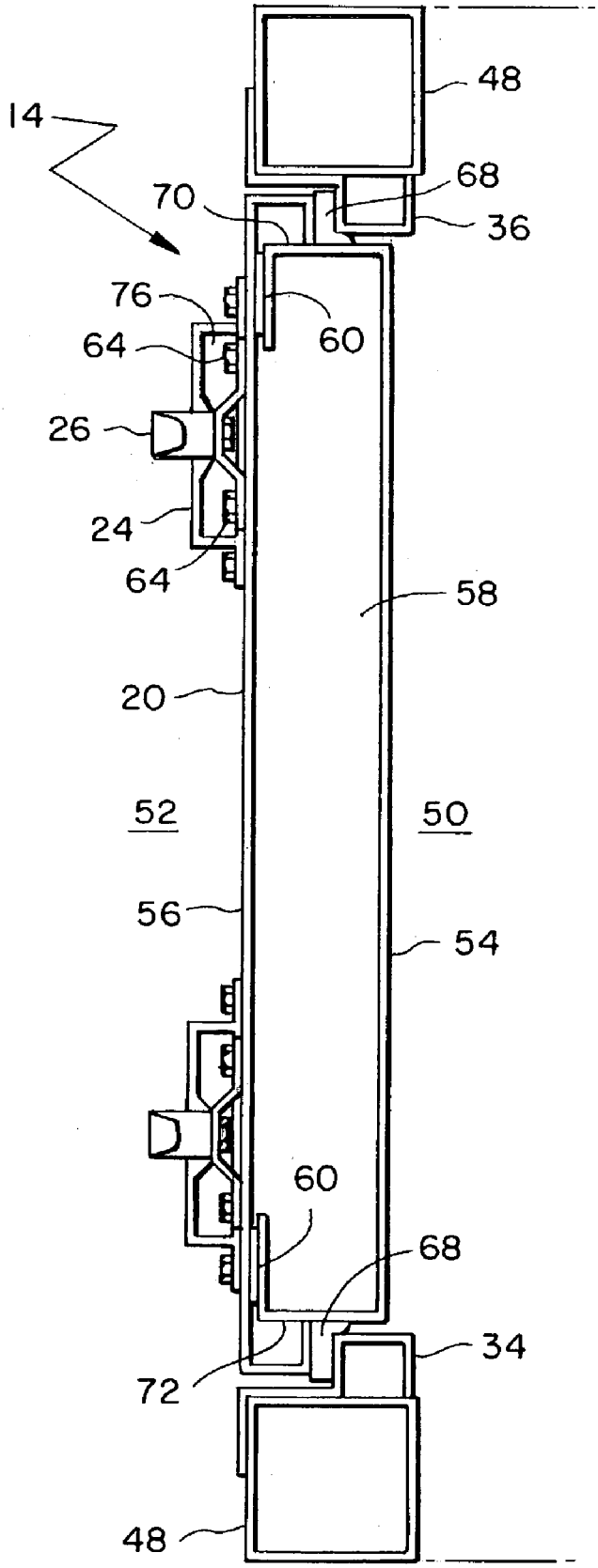
FIG. 4 is a cross-sectional view taken along line 4—4 of FIG. 1.

The assembled doorframe 18, with or without door 20 being attached, can then be attached in a conventional manner to enclosure 16. Enclosure 16 may be comprised of sheet metal panels 46 (FIGS. 1 and 5) attached to an enclosure frame 48 (FIGS. 1 and 4).

Figure 5:
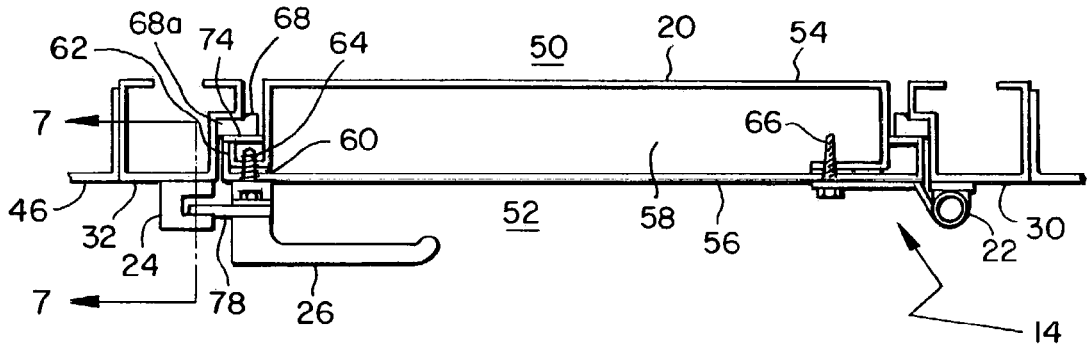
FIG. 5 is a cross-sectional view taken along line 5—5 of FIG. 1.

Since a temperature differential usually exists between an interior 50 and an exterior 52 of enclosure 16, door 20 can be insulated to help avoid condensation from forming on the colder side of the door. In some embodiments, door 20 comprises an inner panel 54 attached to an outer panel 56 with the space between the two panels being filled with insulation 58, as shown in FIGS. 4 and 5. Panels 54 and 56 can be made of sheet metal and formed as shown in the drawing figures.

Double-sided adhesive tape 60 (i.e., tape with opposite facing adhesive surfaces) can be placed between panels 54 and 56 for three reasons. Tape 60 helps hold panels 54 and 56 together, it provides a seal that helps keep moisture from seeping between panels 54 and 56 and contaminating insulation 58, and it provides a thermal break that inhibits heat transfer between adjacent surfaces of panels 54 and 56.

Other features of door 20 include a peripheral side flange 62 of inner panel 54, dual-purpose screws 64 and 66, and a peripheral gasket 68. Peripheral flange 62 lies along a vertical edge of inner panel 54: between an upper edge 70 and a lower edge 72 of panel 54 (FIG. 4). To help hold panels 54 and 56 together, flange 62 protrudes outwardly from inner panel 54 to be captured underneath an inwardly extending flange 74 of outer panel 56.

Panels 54 and 56 are further held together by dual-purpose screws 64 and 66, as shown in FIG. 5. In addition to fastening inner panel 54 directly to outer panel 56, screws 64 fasten latch 26 to door 20, and screws 66 fasten hinge 22 to door 20. In some cases, screws 64 or 66 may penetrate tape 60 to ensure a more positive sealed connection between panels 54 and 56.

Figure 6:
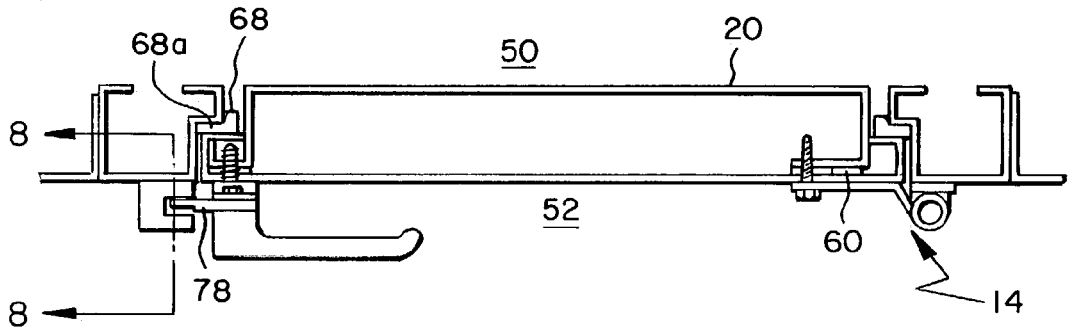
FIG. 6 is a cross-sectional view similar to FIG. 5 but showing the latch in a negative pressure position.

Gasket 68 provides a compressive seal between door 20 and doorframe 18. Although gasket 68 is shown attached to door 20, gasket 68 can alternatively be affixed to doorframe 18. The range of movement of latch 26 within strike 24 limits the gasket's extent of compression, thereby preventing gasket 68 from being crushed. FIG. 5 shows edge **68*a* of gasket 68 compressed to a minimum predetermined limit, and FIG. 6 shows edge 68*a* of gasket 68** compressed to a maximum predetermined limit.

Figure 7:
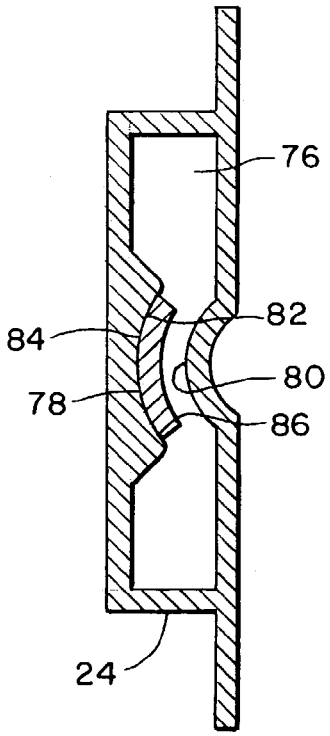
FIG. 7 is a cross-sectional view taken along line 7—7 of FIG. 5.
Figure 8:
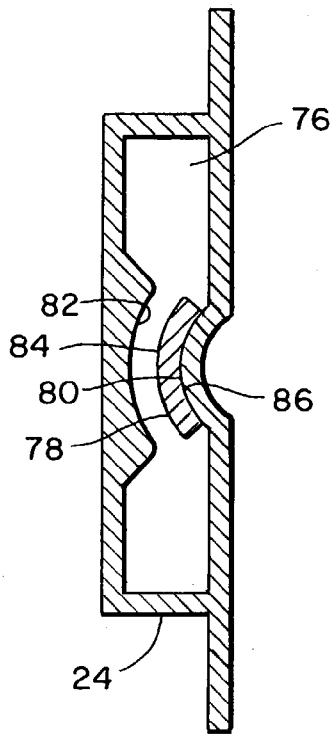
FIG. 8 is a cross-sectional view taken along line 8—8 of FIG. 6.

Strike 24 includes a cavity 76 the size and shape of which ensures proper compression of gasket 68 and helps hold pawl 78 of latch 26 in either of two engaged positions within cavity 76, as shown in FIGS. 7 and 8. One engaged position, shown in FIG. 7, is referred to as a positive pressure position. Where the nature and operation of blower 12 is such as to create a positive pressure within cabinet 10, the positive pressure acts against door 20 to urge it outward. That, in turn, urges pawl 78 of latch 26 into the position illustrated in FIG. 7. The other engaged position, shown in FIG. 8, is referred to as a negative pressure position. Where the nature and operation of blower 12 is such as to create a negative pressure within cabinet 10, such negative pressure creates a pressure differential across door 20 which draws the door inwardly and causes pawl 78 of latch 26 to be positioned in the position illustrated in FIG. 8. In both of the engaged positions, pawl 78 of latch 26 extends into cavity 76 and engages strike 24 but in neither position is gasket 68 overcompressed.

Figure 9:
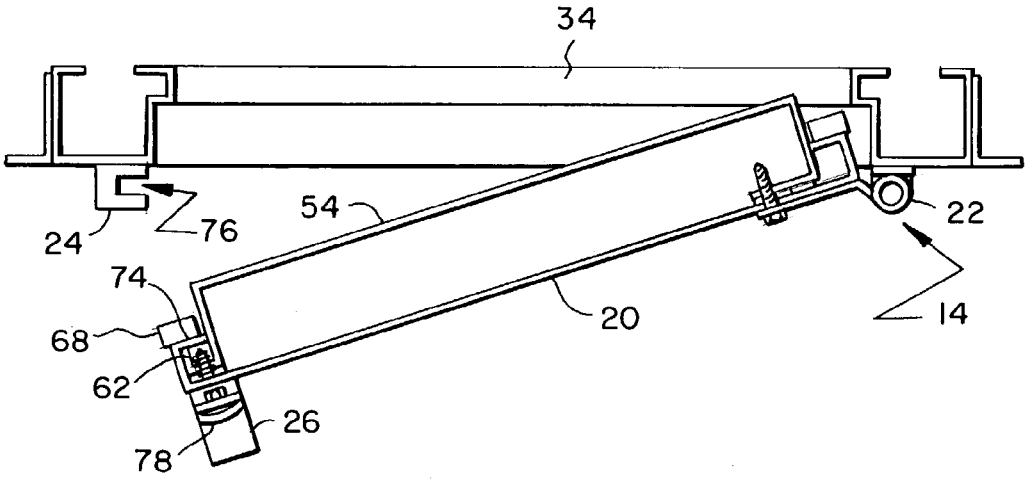
FIG. 9 is a cross-sectional view similar to FIGS. 5 and 6 but showing the door partially open.

To open door 20, latch 26 can be manually rotated to a disengaged position, as shown in FIG. 9. In the disengaged position, pawl 78 is rotated out from within cavity 76 of strike 24.

To inhibit latch 26 from disengaging or rotating on its own from an engaged position, strike 24 includes a protrusion 80 and a recess 82 that can be engaged by one of two mating surfaces of pawl 78. In the positive pressure position, an outer surface 84 of pawl 78 engages recess 82. In the negative pressure position, an inner surface 86 of pawl 78 engages protrusion 80.

Figure 10:
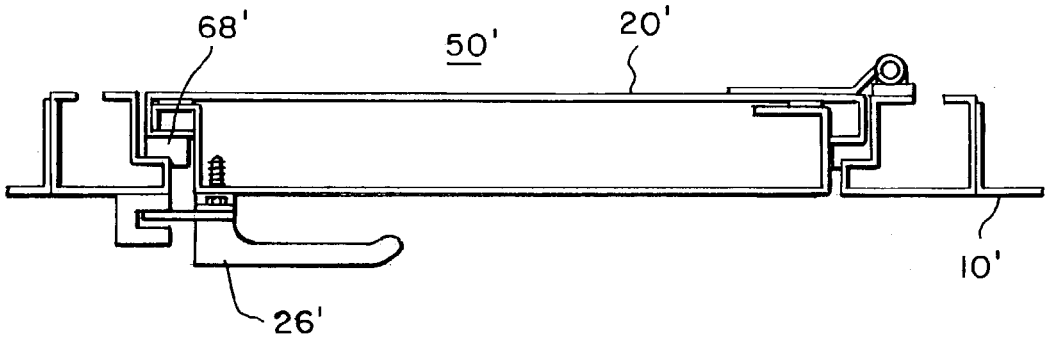
FIG. 10 is a cross-sectional view similar to FIG. 5 but showing an inwardly opening door.
Figure 11:
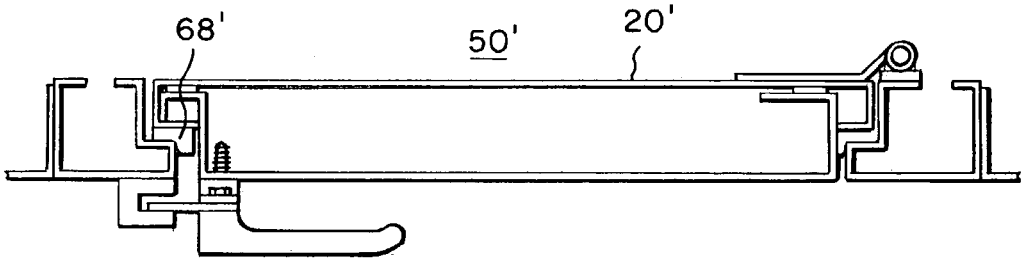
FIG. 11 is a cross-sectional view similar to FIG. 6 but showing the inwardly opening door of FIG. 10.
Figure 12:
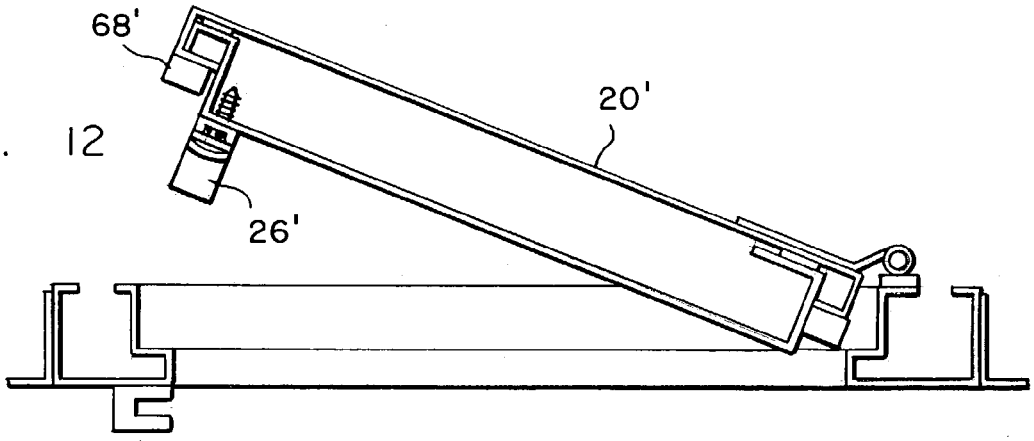
FIG. 12 is a cross-sectional view similar to FIG. 9 but showing the inwardly opening door of FIG. 10.

If there is an insufficient pressure differential across the door, the resilience of the door gasket may itself urge the door to one of the two engaged positions, depending on whether the door swings inward or outward to open. Door 20 of FIG. 5, for example, swings outward to open, wherein gasket 68 urges latch 26 to its positive pressure position when there is no pressure differential across door 20. FIGS. 10, 11 and 12, however, show a door 20' that swings inward to open, wherein gasket 68' urges latch 26' to its negative pressure position of FIG. 10 when there is no pressure differential across door 20'.

Either gasket 68' or negative pressure within an interior 50' of cabinet 10' can urge latch 26' to its negative pressure position of FIG. 10. A positive pressure within interior 50' can exert pressure on door 20' to urge latch 26' to its positive pressure position of FIG. 11. Rotating latch 26' allows door 20' to be swung inward to open, as shown in FIG. 12. Otherwise, the embodiment of FIGS. 10, 11 and 12 is similar to that of FIGS. 5, 6 and 9.

Although the invention is described with reference to a preferred embodiment, it should be appreciated by those skilled in the art that other variations are well within the scope of the invention. Therefore, the scope of the invention is to be determined by reference to the claims, which follow.

We claim:

1. A cabinet for air handling equipment, comprising:

an enclosure defining an interior and an exterior;

a blower in fluid communication with the interior of the enclosure to create a pressure differential between the interior and the exterior;

a right jamb connected to the enclosure;

a left jamb connected to the enclosure;

a threshold extending between the right jamb and the left jamb;

a lintel above the threshold and extending between the right jamb and the left jamb, whereby the right jamb, the left jamb, the threshold, and the lintel define an access opening into the enclosure;

a door for selectively covering the access opening, a hinge that pivotally connects the door to one of the right jamb and the left jamb;

a latch attached to the door, wherein the latch includes an inner surface and an outer surface facing in generally opposite directions; and a strike attached to at least one of the right jamb, the left jamb, the lintel and the threshold, wherein the latch is selectively movable between a disengaged position spaced apart from the strike and two engaged positions engaging the strike, wherein the two engaged positions include a positive pressure position and a negative pressure position, wherein the outer surface engages the strike and the inner surface disengages the strike when the latch is in the positive pressure position, and the inner surface engages the strike and the outer surface disengages the strike when the latch is in the negative pressure position.

2. The cabinet of claim 1, wherein at least one of the threshold, the lintel, the right jamb, and the left jamb includes a tab that protrudes into a slit defined by at least one of the threshold, the lintel, the right jamb, and the left jamb.

3. The cabinet of claim 1, wherein at least one of the threshold and the lintel includes a tab that protrudes into a slit defined by at least one of the right jamb and the left jamb.

4. The cabinet of claim 1, wherein the blower creating a positive air pressure in the cabinet urges the latch to the positive pressure position.

5. The cabinet of claim 1, wherein the blower creating a negative air pressure in the cabinet urges the latch to the negative pressure position.

6. The cabinet of claim 1, wherein the strike has a recess and a protrusion that generally face each other, wherein the latch moves between engaging the recess to engaging the protrusion upon the latch moving between the positive pressure position and the negative pressure position.

7. The cabinet of claim 1, wherein the latch is rotatable between the disengaged position and at least one of the two engaged positions.

8. The cabinet of claim 1, wherein the strike has two strike-mounting holes having a first hole spacing, and the hinge has two hinge-mounting holes having a second hole spacing, wherein the first hole spacing is substantially equal to the second hole spacing to enable interchanging the hinge and the strike.

9. The cabinet of claim 1 wherein said door includes an outer panel attached to an inner panel, adhesive tape connecting the outer panel to the inner panel.

10. The cabinet of claim 1, wherein said door has an outer panel attached to an inner panel and wherein the inner panel includes an upper edge, a lower edge, and a peripheral side flange therebetween, wherein the peripheral flange protrudes outwardly from the door to be captured underneath an inwardly extending flange of the outer panel.

11. The cabinet of claim 9, wherein the adhesive tape is double-sided tape with one adhesive surface bonded to the outer panel and an opposite facing adhesive surface bonded to the inner panel.

12. The cabinet of claim 9, wherein at least one of the threshold, the lintel, the right jamb, and the left jamb includes a tab that protrudes into a slit defined by at least one of the threshold, the lintel, the right jamb, and the left jamb.

13. The cabinet of claim 9, wherein at least one of the threshold and the lintel includes a tab that protrudes into a slit defined by at least one of the right jamb and the left jamb.

14. The cabinet of claim 1, wherein said door has an outer panel attached to an inner panel and further comprising a dual-purpose screw that fastens the hinge to the door and fastens the outer panel directly to the inner panel, wherein the dual-purpose screw protrudes through the adhesive tape.

15. The cabinet of claim 1, wherein said door has an outer panel attached to an inner panel and further comprising a dual-purpose screw that fastens the latch to the door and fastens the outer panel to the inner panel.

16. The cabinet of claim 1, further comprising a tab that extends from at least one of the threshold, the lintel, the right jamb, and the left jamb, said tab protruding through a slit defined by at least one of the threshold, the lintel, the right jamb, and the left jamb.

17. The cabinet of claim 16 wherein the portion of said tab that protrudes through said slit is twisted so as to prevent the withdrawal of said tab from said slit.

18. The cabinet of claim 17, wherein the tab extends from at least one of the lintel and the threshold, and wherein the slit is defined by at least one of the right jamb and the left jamb.

* * * * *